US009798270B2

(12) United States Patent
Ueno

(10) Patent No.: US 9,798,270 B2
(45) Date of Patent: Oct. 24, 2017

(54) TONER CONVEYING DEVICE TO PREVENT TONER FROM REMAINING AT DISCHARGING PART AND IMAGE FORMING APPARATUS INCLUDING SUCH TONER CONVEYING DEVICE

(71) Applicant: KYOCERA Document Solutions Inc., Osaka (JP)

(72) Inventor: Masahiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/256,011

(22) Filed: Sep. 2, 2016

(65) Prior Publication Data

US 2017/0068187 A1 Mar. 9, 2017

(30) Foreign Application Priority Data

Sep. 9, 2015 (JP) ..... 2015-177626

(51) Int. Cl.
*G03G 15/08* (2006.01)
*G03G 21/10* (2006.01)

(52) U.S. Cl.
CPC ..... *G03G 15/0891* (2013.01); *G03G 21/105* (2013.01)

(58) Field of Classification Search
CPC ..... G03G 15/0891; G03G 21/105
USPC ..... 399/358
See application file for complete search history.

(56) References Cited

U.S. PATENT DOCUMENTS 5,629,758 A * 5/1997 Kageyama ..... G03G 15/0822 366/319
6,157,807 A * 12/2000 Takenouchi ..... G03G 21/105 399/358
2014/0044465 A1* 2/2014 Mekada ..... G03G 21/12 399/358

FOREIGN PATENT DOCUMENTS

JP 2011-242576 A 12/2011
JP 2012083402 A * 4/2012

* cited by examiner

*Primary Examiner* — Billy Lactaoen
(74) *Attorney, Agent, or Firm* — Studebaker & Brackett PC

(57) ABSTRACT

A toner conveying device includes a housing, a screw, a discharging part and a removing member. The housing houses toner. The screw is formed by fixing a vane of a spiral shape to a circumferential face of a rotation axis rotatably supported in the housing. The discharging part is formed to be able to discharge the toner conveyed by the screw, to an outside of the housing. The removing member is elongated from the rotation axis to an outside in a radial direction, rotates with the screw and removes the toner remaining at the discharging part. The removing member is formed in a comb shape formed by continuously forming a recess and a protrusion at a free end part of the removing member.

13 Claims, 13 Drawing Sheets

TONER CONVEYING DEVICE TO PREVENT TONER FROM REMAINING AT DISCHARGING PART AND IMAGE FORMING APPARATUS INCLUDING SUCH TONER CONVEYING DEVICE

INCORPORATION BY REFERENCE

This application is based on and claims the benefit of priority from Japanese Patent application No. 2015-177626 filed on Sep. 9, 2015, the entire contents of which are incorporated herein by reference.

BACKGROUND

The present disclosure relates to a toner conveying device and an image forming apparatus including this.

An electro-photographic image forming apparatus includes a cleaning device which removes toner (also referred to as "remaining toner" below) remaining on a surface of a photoseptor.

For instance, the cleaning device includes a cleaning member fixed to a container which comes into slide contact with a photosensitive drum, and a toner conveying screw which is rotatably supported in the container. The toner conveying screw conveys the remaining toner collected by the cleaning member, to an outlet (downstream end).

However, when the conveyance amount of the remaining toner increases, the remaining toner remains near the outlet in the cleaning device. In this case, it is not possible to appropriately discharge the remaining toner from the outlet. For instance, a scraper of a flat shape is provided to the toner conveying screw. The scraper rotates with the toner conveying screw and scrapes the toner remaining near the outlet.

However, there is a case where the remaining toner readily adheres to the toner conveying screw or the scraper in high-temperature environment, for instance. The remaining toner adhered to the scraper is pushed out by the remaining toner conveyed by the toner conveying screw, and remains at a bearing part at a downstream side of the toner conveying screw. The remaining toner remaining at the bearing part thermally bonds to the toner conveying screw and the bearing part. Thermal bonding of the remaining toner disables the toner conveying screw to smoothly rotate.

SUMMARY

According to one aspect of the present disclosure, a toner conveying device includes a housing, a screw, a discharging part and a removing member. The housing houses toner. The screw is formed by fixing a vane of a spiral shape to a circumferential face of a rotation axis rotatably supported in the housing. The discharging part is formed to be able to discharge the toner conveyed by the screw, to an outside of the housing. The removing member is elongated from the rotation axis to an outside in a radial direction, rotates with the screw and removes the toner remaining at the discharging part. The removing member is formed in a comb shape formed by continuously forming a recess and a protrusion at a free end part of the removing member.

According to one aspect of the present disclosure, an image forming apparatus includes an image carrier and a toner conveying device. The image carrier carries a toner image. The toner conveying device removes toner remaining on a surface of the image carrier. The toner conveying device includes a housing, a screw, a discharging part and a removing member. The housing houses toner. The screw is formed by fixing a vane of a spiral shape to a circumferential face of a rotation axis rotatably supported in the housing. The discharging part is formed to be able to discharge the toner conveyed by the screw, to an outside of the housing. The removing member is elongated from the rotation axis to an outside in a radial direction, rotates with the screw and removes the toner remaining at the discharging part. The removing member is formed in a comb shape formed by continuously forming a recess and a protrusion at a free end part of the removing member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, a preferable embodiment of the present disclosure will be described with reference to the appended drawings. It is noted that the following description will be made by assuming a front side of FIGS. 1, 4, 7 through 9 and 11 through 13 to be a front side of an image forming apparatus of the present embodiment and based on directions indicated in each drawing.

Figure 1:
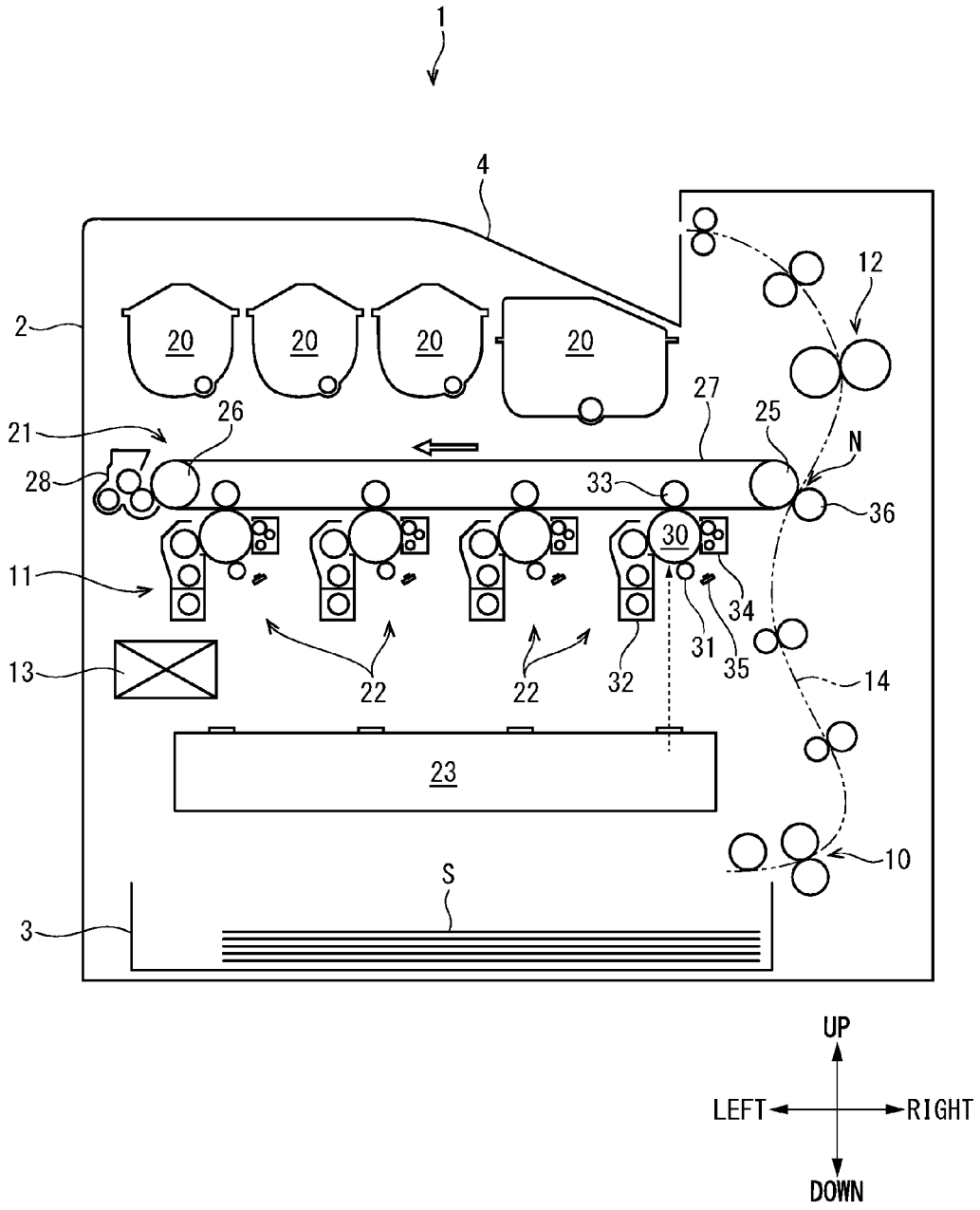
FIG. 1 is a sectional view schematically showing an inner structure of a color printer according to a first embodiment of the present disclosure.
Figure 2:
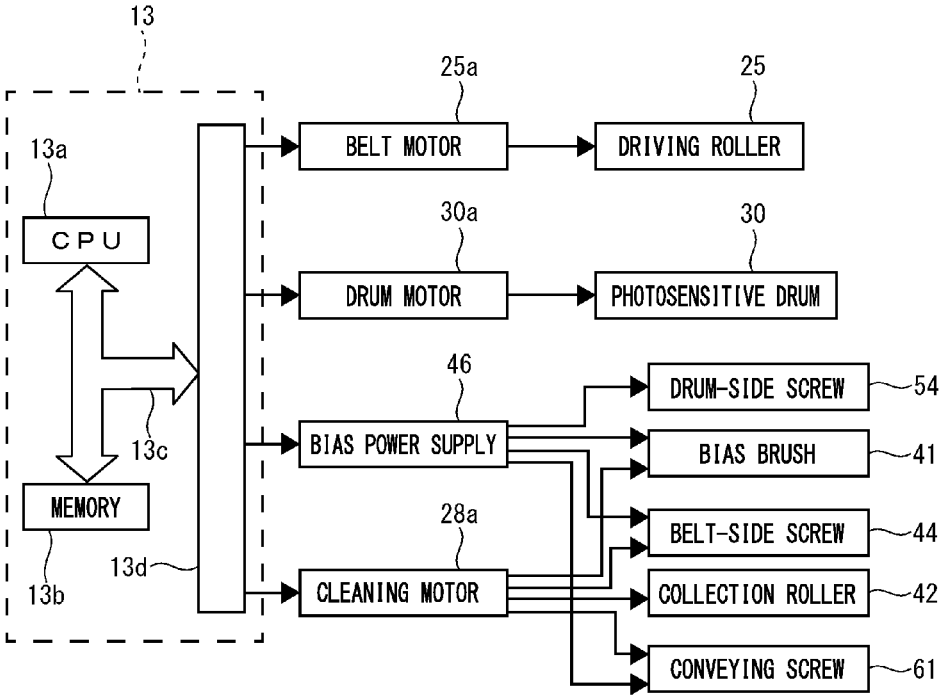
FIG. 2 is a block diagram showing an electrical configuration of the color printer according to the first embodiment of the present disclosure.

With reference to FIGS. 1 and 2, an entire construction of a color printer 1, i.e., an image forming apparatus, according to a first embodiment will be described. FIG. 1 is a sectional view schematically showing an inner structure of the color printer 1. FIG. 2 is a block diagram showing an electrical configuration of the color printer 1.

As shown in FIG. 1, the color printer 1 includes an apparatus body 2, a sheet feed cassette 3 and a sheet discharge tray 4. The sheet feed cassette 3 is provided drawably in a lower part of the roughly box-like formed apparatus body 2. A sheet S (bundle of the sheets S) is stored in the sheet feed cassette 3. The sheet discharge tray 4 is provided in a upper part of the apparatus body 2. It is noted that the sheet S is not limited to a sheet of paper and may be a resin film or the like.

The color printer 1 includes a sheet feeding part 10, an image forming part 11, a fixing unit 12 and a control device 13 within the apparatus body 2. The sheet feeding part 10 is provided upstream of a conveying path 14 extended from the sheet feed cassette 3 to the sheet discharge tray 4. The image forming part 11 is provided at an intermediate part of the conveying path 14. The fixing unit 12 is provided downstream of the conveying path 14. The control device 13 integrally controls the color printer 1.

The image forming part 11 includes four tonner containers 20, an intermediate transfer unit 21, four drum units 22 and an optical scanning device 23. The four toner containers 20 are arrayed in parallel in a left-right direction under the sheet discharge tray 4. The intermediate transfer unit 21 is disposed under the respective toner containers 20. The four drum units 22 are arrayed in parallel in the left-right direction under the intermediate transfer unit 21. The optical scanning unit 23 is disposed under the respective drum units 22.

The four tonner containers 20 house toners (developing agents) of four colors (yellow, magenta, cyan, black). It is noted that the toner may be a single-component developing agent made of a magnetic toner or may be a double-component developing agent including a toner and a carrier.

The intermediate transfer unit 21 includes a driving roller 25, a driven roller 26, an intermediate transfer belt 27 and a belt cleaning device 28. The driving roller 25 is arranged at a right side in the apparatus main body 2, and the driven roller 26 is arranged at a left side in the apparatus main body 2. The intermediate transfer belt 27 is wound around the driving roller 25 and the driven roller 26. The belt cleaning device 28 is arranged at a left side of the driven roller 26.

The driving roller 25 is connected to a belt motor 25*a* via a gear train (not shown) (see FIG. 2). The driven roller 26 is biased in a left direction by a coil spring 26*a*, and applies a predetermined tension to the intermediate transfer belt 27 (see FIG. 4). The intermediate transfer belt 27 runs counterclockwise by driving the belt motor 25*a*. The belt cleaning device 28 removes the remaining toner adhered to the surface of the intermediate transfer belt 27.

The four drum units 22 are provided corresponding to the toners of the respective colors. Each of the drum units 22 includes a photosensitive drum 30, a charging device 31, a developing device 32, a primary transfer roller 33, a drum cleaning device 34 and a static eliminator 35. It is noted that the four drum units 22 each have a similar configuration; and therefore, one of the drum units 22 will be described hereinafter.

The photosensitive drum 30 which is an image carrier is rotatably arranged in contact with a lower surface of the intermediate transfer belt 27. The photosensitive drum 30 is connected to a drum motor 30*a* via a gear train (not shown) (see FIG. 2). The charging device 31, the developing device 32, the primary transfer roller 33, the drum cleaning device 34 and the static eliminator 35 are disposed in sequential order of the transferring steps around the photosensitive drum 30. The primary transfer roller 33 is disposed to be opposed to the photosensitive drum 30 while the intermediate transfer belt 27 is sandwiched therebetween. A secondary transfer roller 36 comes into pressure contact with a right side of the intermediate transfer belt 27 (driving roller 25) so as to form a secondary transfer nip part N.

As shown in FIG. 2, the control device 13 includes a CPU (Central Processing Unit) 31*a*, a memory 13*b*, a bus 13*c* and an interface 13*d*.

The CPU 13*a* executes arithmetic operation processing according to each program. The memory 13*b* stores programs used for the arithmetic operation processing performed by the CPU 13*a*, rated values of various biases, and the like. The memory 13*b* temporarily stores arithmetic operation results of the CPU 13*a* and the like. The bus 13*c* connects the CPU 13*a*, the memory 13*b* and the interface 13*d*. The interface 13*d* is electrically connected with various control targets, such as the belt motor 25*a* and the drum motor 30*a*. Incidentally, although not shown, the interface 13*d* is connected with a driving device of a motor and a power supply which, and is optionally controlled by the CPU 13*a*.

Here, an operation of the color printer 1 will be described. A control device 13 executes image forming processing as shown below, on the basis of input image data.

Each of the charging devices 31 charges a surface of the photosensitive drum 30. The optical scanning unit 23 performs exposure (see a broken line arrow in FIG. 1) matching image data, to each photosensitive drum 30 so as to form an electrostatic latent image on each photosensitive drum 30. Each of developing device 32 develops the electrostatic latent image to a toner image by using toner supplied from each toner container 20. A primary transfer bias is applied to each primary transfer roller 33 so as to primarily transfer the toner image carried by each photosensitive drum 30 on the intermediate transfer belt 27. Thereby, a full-color toner image is formed on a surface of the intermediate transfer belt 27.

Meanwhile, the sheetS supplied from the sheet feed cassette 3 is conveyed on the conveying path 14 and passes through the secondary transfer nip part N. The secondary transfer bias is applied to the secondary transfer roller 36 so as to secondarily transfer the full-color toner image on the sheet S. The fixing unit 12 fixes the toner image to the sheet S. The sheet S after fixed is ejected to the sheet discharge tray 4. The drum cleaning device 34 removes the remaining toner on the surface of the photosensitive drum 30 after transferred.

Figure 3:
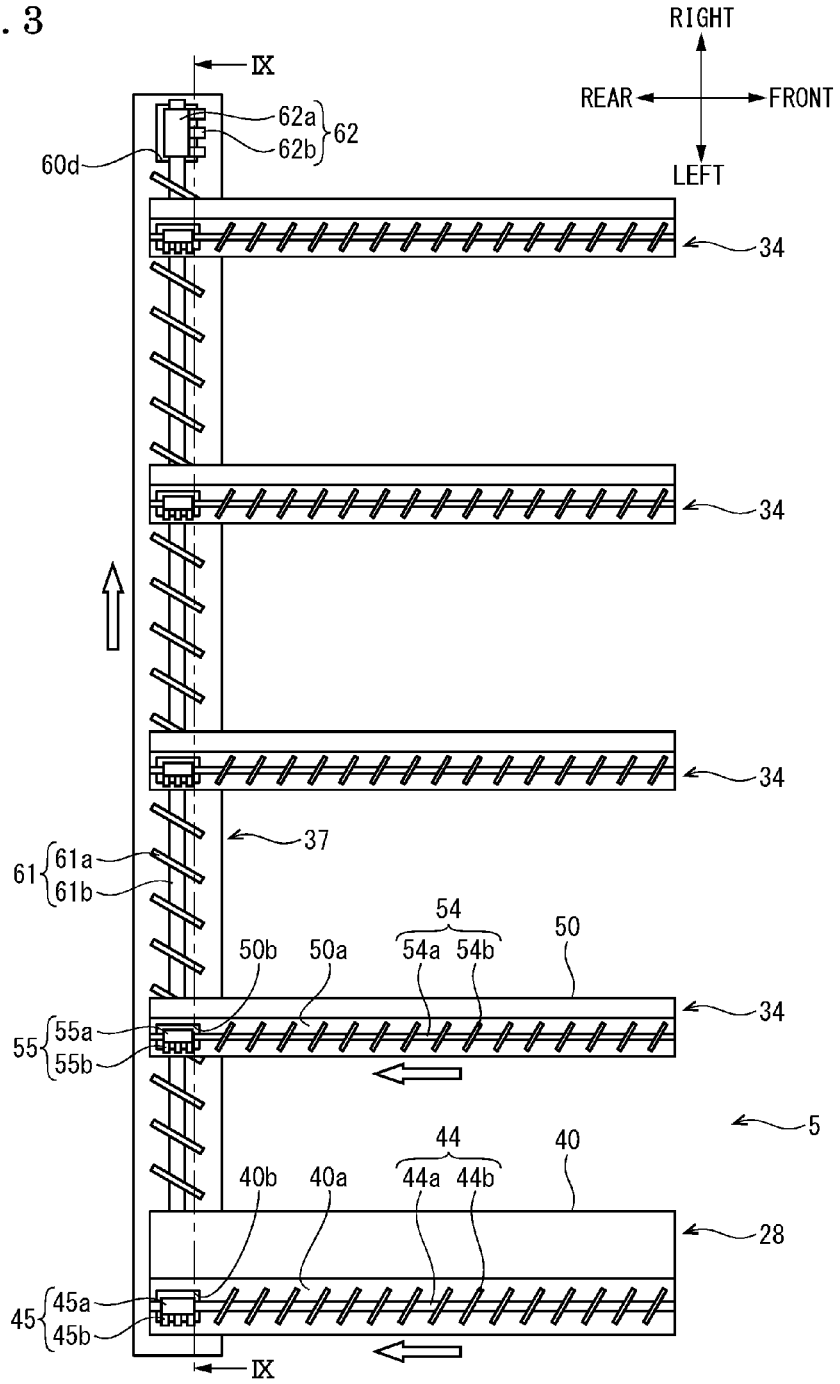
FIG. 3 is a sectional view schematically showing the color printer according to the first embodiment of the present disclosure and a cleaning structure seen from a plan view.
Figure 4:
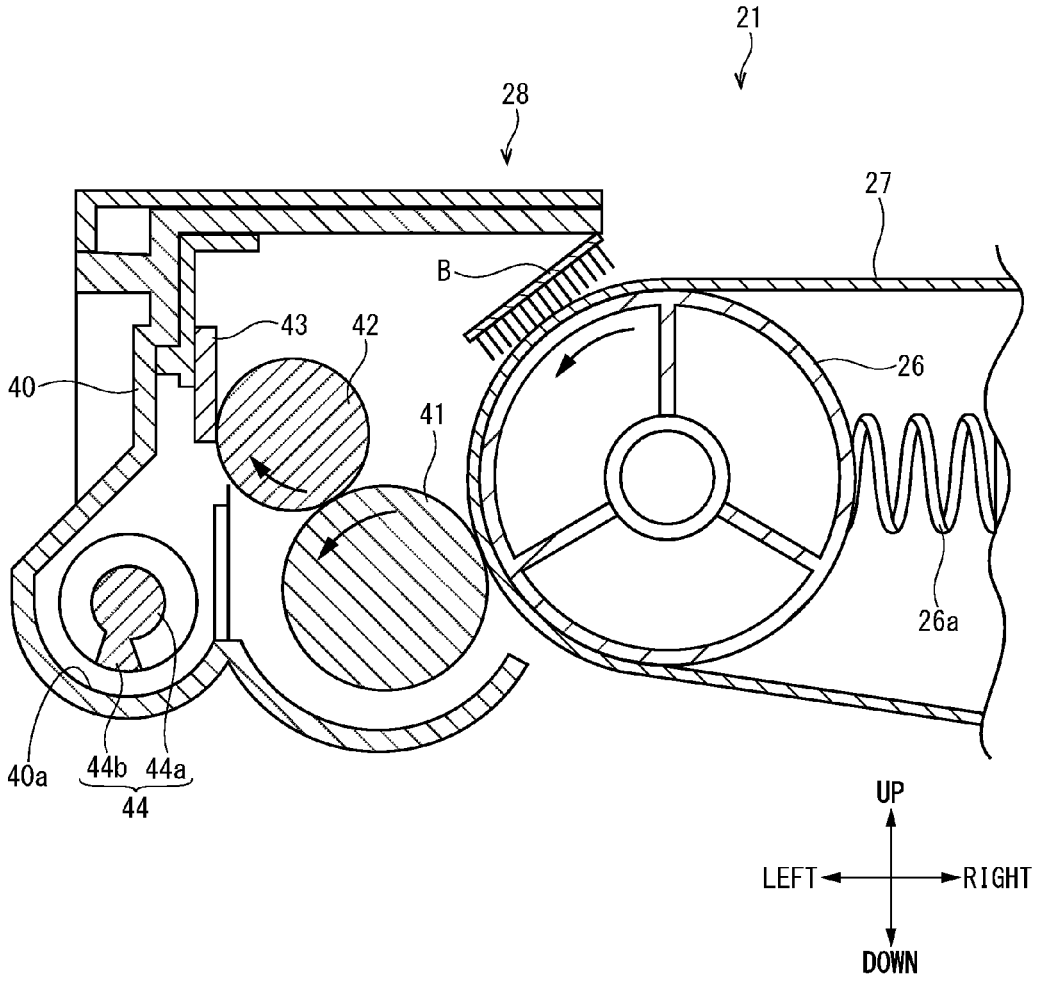
FIG. 4 is a sectional view schematically showing a belt cleaning device according to the first embodiment of the present disclosure.
Figure 5:
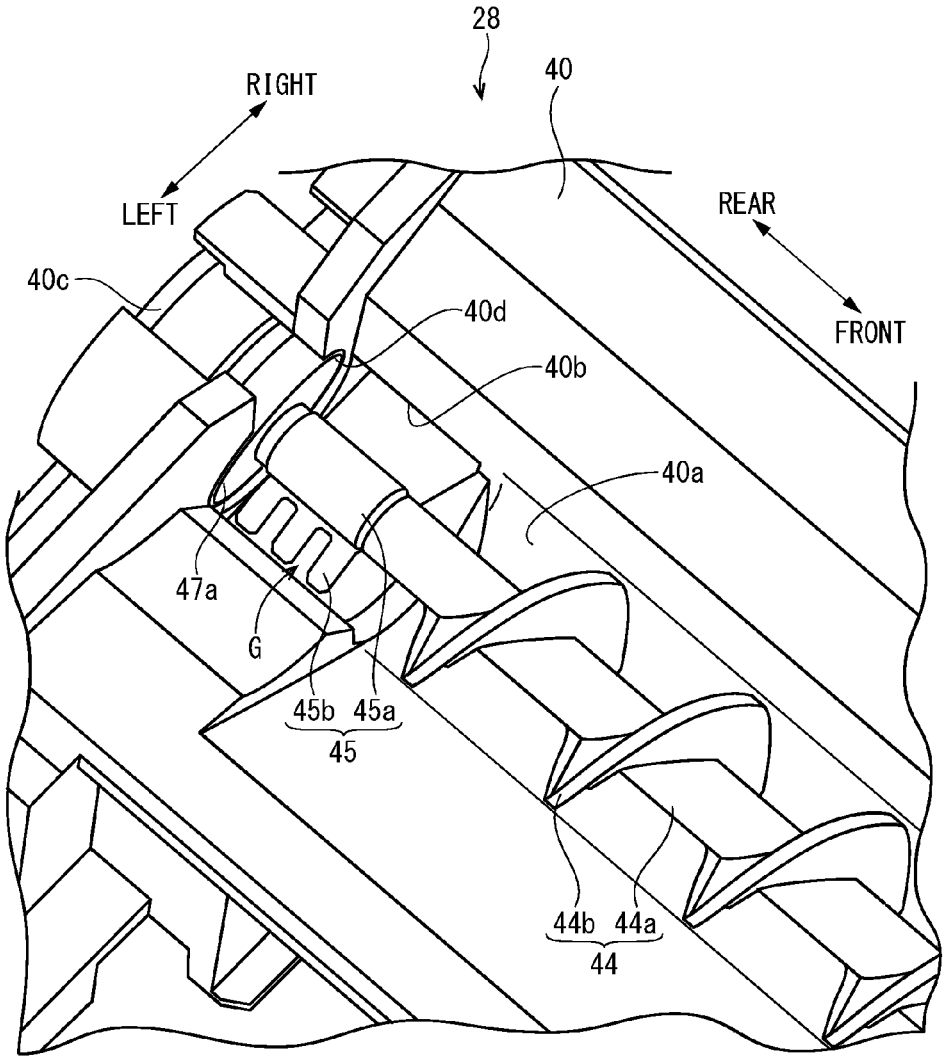
FIG. 5 is a perspective view showing a rear side of the belt cleaning device according to the first embodiment of the present disclosure.
Figure 6:
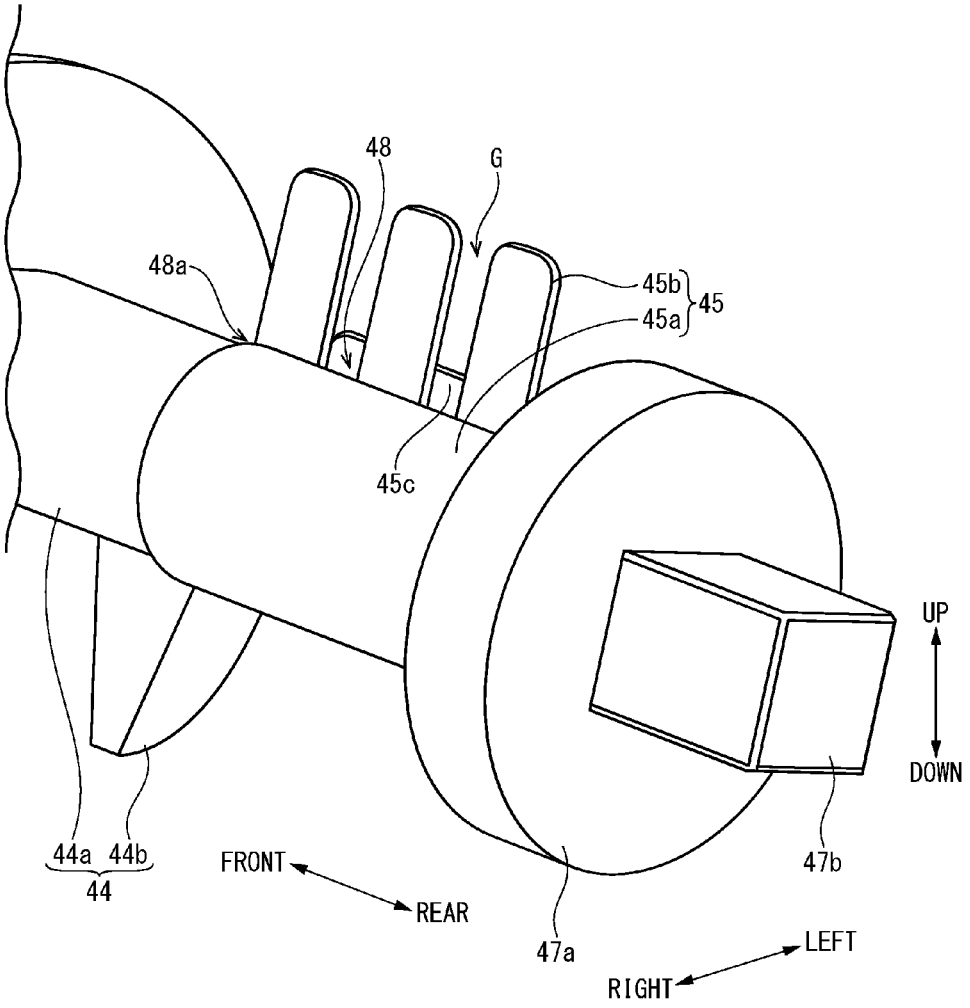
FIG. 6 is a perspective view showing a belt-side removing member of the belt cleaning device according to the first embodiment of the present disclosure.
Figure 7:
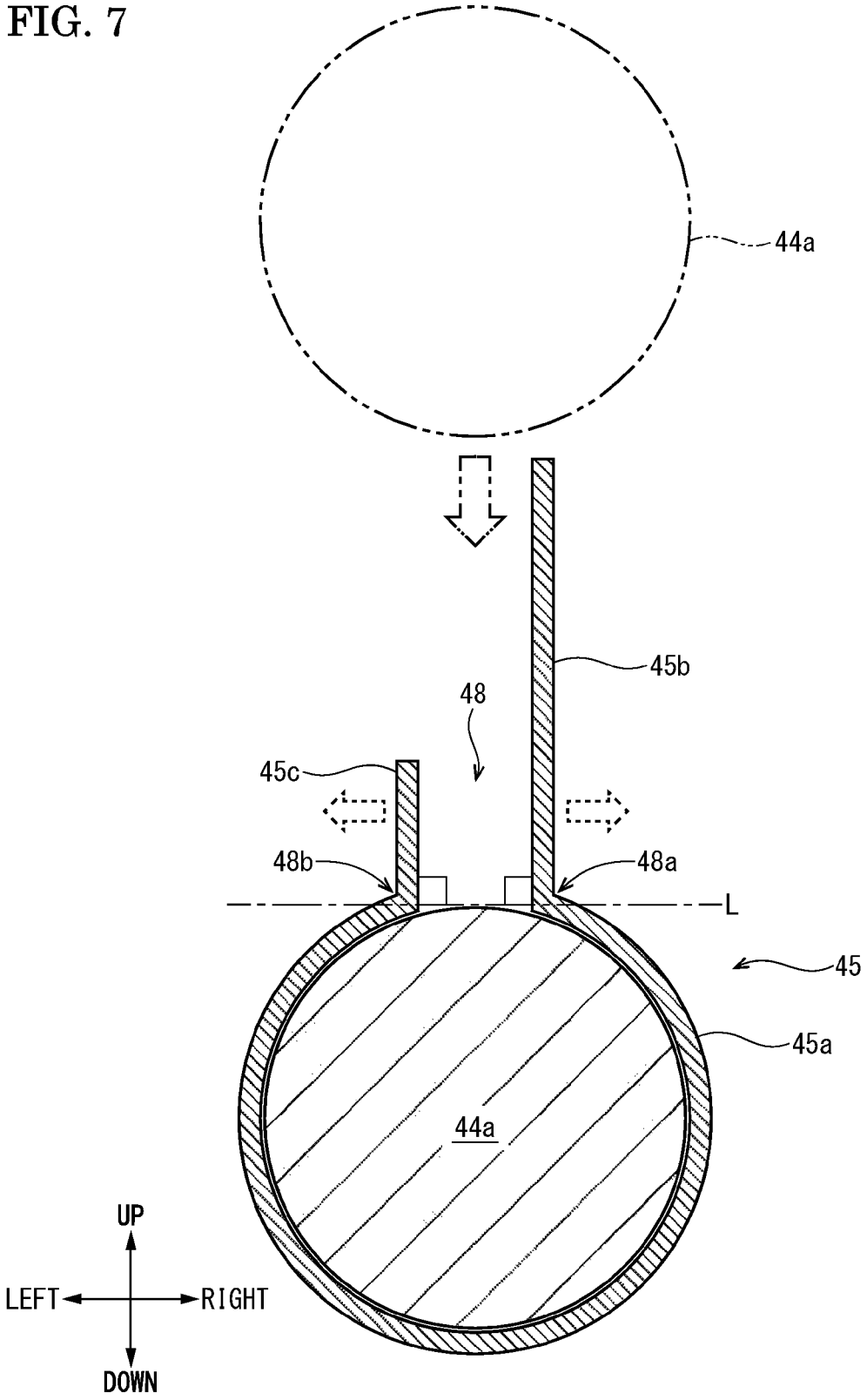
FIG. 7 is a sectional view schematically showing a belt-side removing member of the belt cleaning device according to the first embodiment of the present disclosure.
Figure 8:
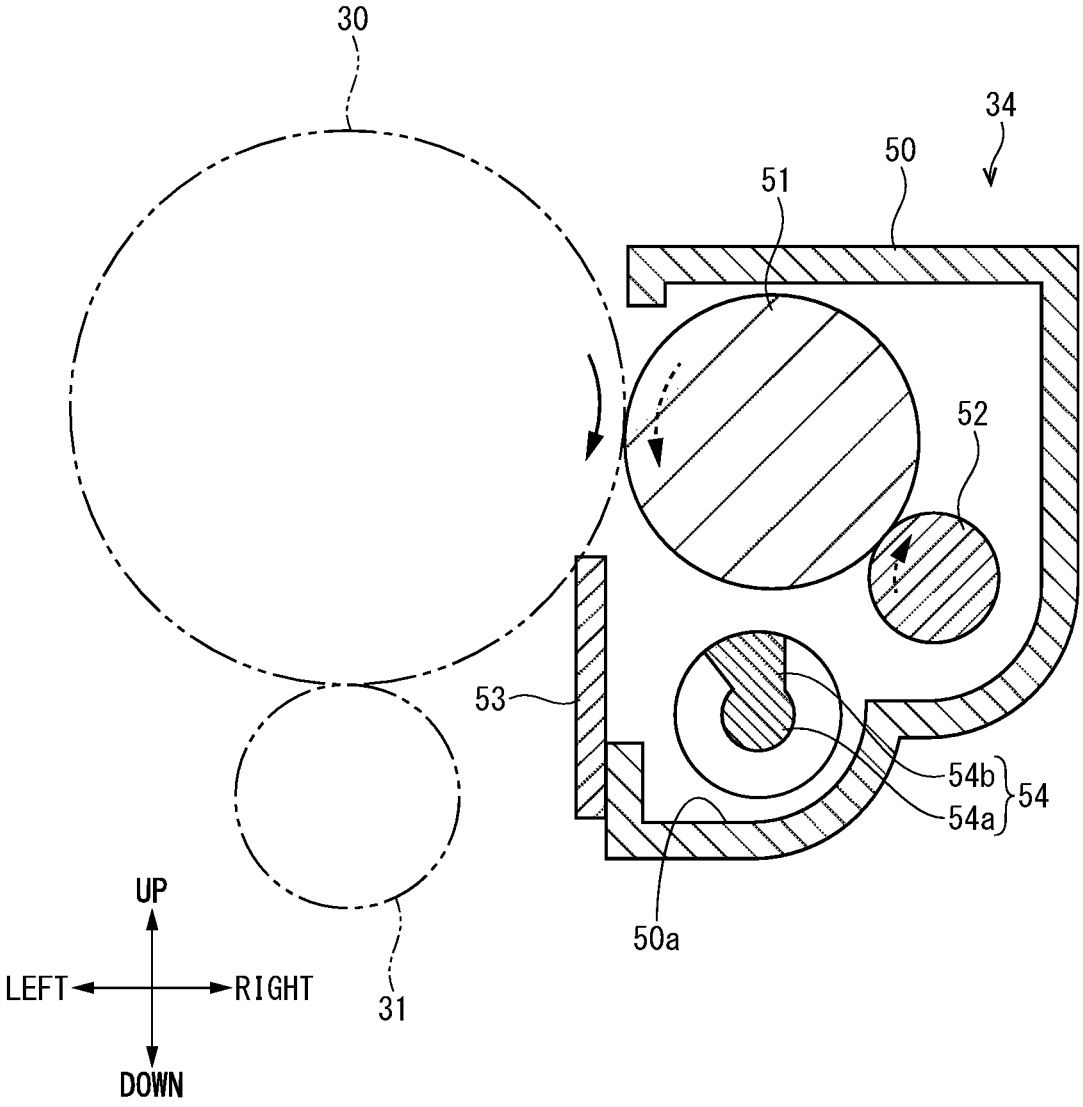
FIG. 8 is a sectional view schematically showing a drum cleaning device according to the first embodiment of the present disclosure.
Figure 9:
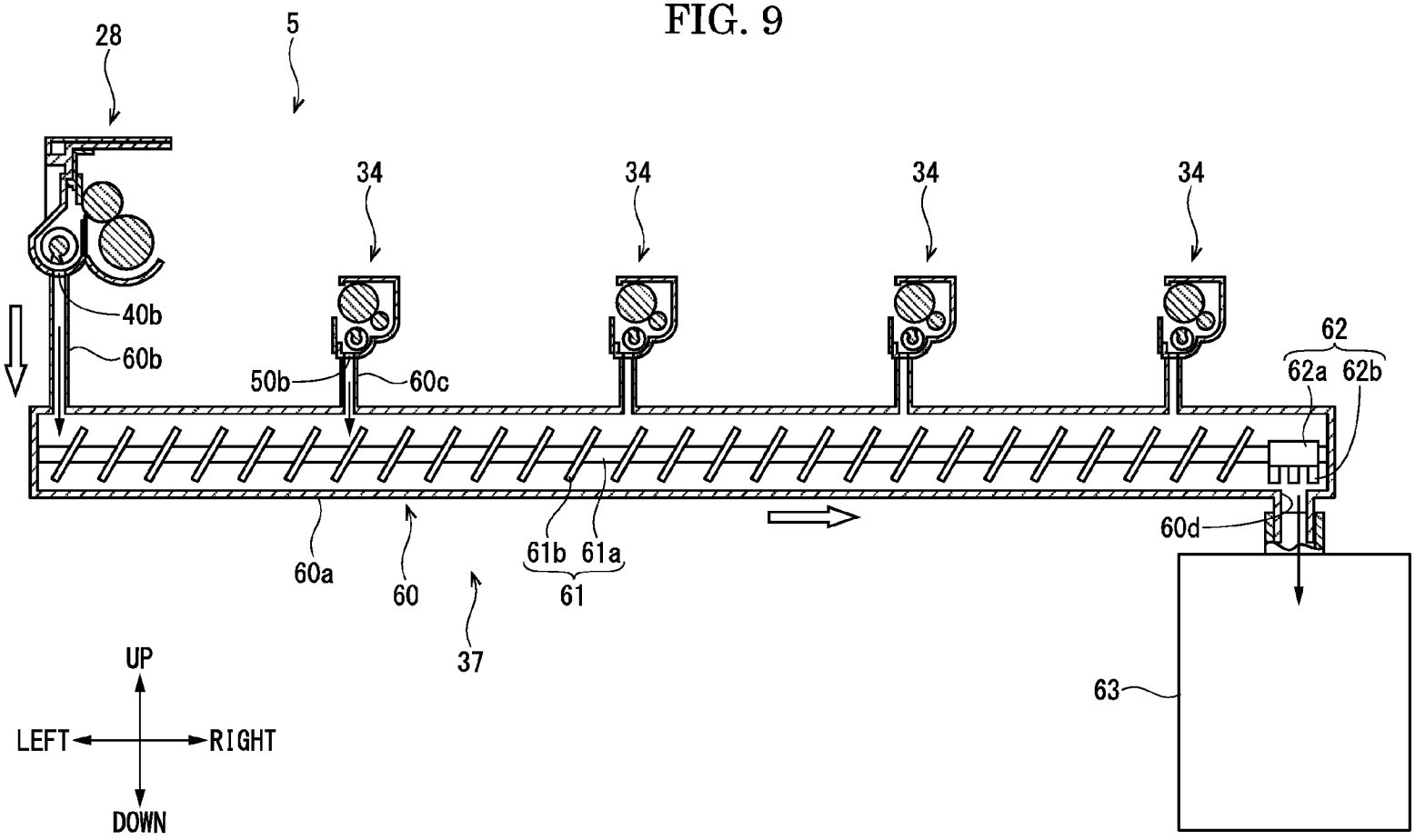
FIG. 9 is a sectional view taken along a line IX-IX in FIG. 3.

Next, a cleaning structure 5 which removes remaining toner form the surface of the intermediate transfer belt 27 and the surface of each photosensitive drum 30 will be described with reference to FIGS. 3 through 9. FIG. 3 is a sectional view schematically showing the cleaning structure 5 seen from a plan view. FIG. 4 is a sectional view schematically showing a belt cleaning device 28. FIG. 5 is a perspective view showing a rear side of the belt cleaning device 28. FIG. 6 is a perspective view showing a belt-side removing member 45 of the belt cleaning device 28. FIG. 7 is a sectional view schematically showing a belt-side removing member 45 of the belt cleaning device 28. FIG. 8 is a sectional view schematically showing a drum cleaning device 34. FIG. 9 is a sectional view taken along a line IX-IX in FIG. 3.

As shown in FIG. 3, the cleaning structure 5 includes the belt cleaning device 28, four drum cleaning device 34 and a discharge conveying device 37. The belt cleaning device 28 removes the remaining toner on the surface of the intermediate transfer belt 27. Each of the drum cleaning devices 34 removes the remaining toner on the surface of the photosensitive drum 30. The discharge conveying device 37 conveys the toner (remaining toner) removed by the belt cleaning device 28 and each drum cleaning device 34, to a toner collection container 63 (see FIG. 9). In addition, the belt cleaning device 28, each drum cleaning device 34 and the discharge conveying device 37 are examples of a "toner conveying device" recited in the claims.

As shown in FIG. 4, the belt cleaning device 28 includes a belt-side housing 40, a bias brush 41, a collection roller 42, a collection blade 43, a belt-side screw 44 and a belt-side removing member 45 (see FIG. 3).

The belt-side housing 40 is formed in a nearly box shape whose right face opposing to the intermediate transfer belt 27 is opened. The belt-side housing 40 houses the remaining toner removed from the surface of the intermediate transfer belt 27.

Incidentally, a bar brush B which comes into slide contact with the intermediate transfer belt 27 is arranged closer to an upper side than the belt-side housing 40. The bar brush B is positioned at an opposite side to a charging polarity of the toner in terms of triboelectric series, and charges the remaining toner adhered to the surface of the intermediate transfer belt 27.

The bias brush 41 is formed in a nearly cylindrical shape elongated in a front and rear direction. The bias brush 41 is supported by the belt-side housing 40 rotatably around an axis. The bias brush 41 is arranged to oppose to a lower left side of the driven roller 26 across the intermediate transfer belt 27. The bias brush 41 is exposed through an opening of the belt-side housing 40, and has an outer circumferential face in contact with the intermediate transfer belt 27.

The bias brush 41 is electrically connected to a bias power supply 46 (see FIG. 2). The bias power supply 46 is electrically connected to the interface 13*d* (see FIG. 2). The bias power supply 46 is controlled by the control device 13 (CPU 13*a*) to apply a bias of a polarity opposite to the charging polarity of the remaining toner, to the bias brush 41.

The collection roller 42 is formed in a nearly cylindrical shape elongated in the front and rear direction. The collection roller 42 is supported by the belt-side housing 40 rotatably around the axis. The collection roller 42 is arranged at an upper left side of the bias brush 41. An outer circumferential face of the collection roller 42 is in contact with the outer circumferential face of the bias brush 41.

The collection blade 43 is formed in a flat shape made of a synthetic resin, for instance. The collection blade 43 is fixed to the belt-side housing 40 at an upper left of the collection roller 42. A distal end part of the collection blade 43 comes into contact with the outer circumferential face of the collection roller 42.

As shown in FIGS. 3 through 5, the belt-side screw 44 is elongated in the front and rear direction, and is rotatably supported axially around the axis in the belt-side housing 40. The belt-side screw 44 is formed by fixing screw vanes 44*b* of spiral shapes to a circumferential face of a rotation axis 44*a* pivotally supported by the belt-side housing 40. The belt-side screw 44 is made of a conductive resin material, for instance.

The belt-side screw 44 is housed in a belt-side housing chamber 40*a* recessed in a left bottom surface of the belt-side housing 40. The belt-side housing chamber 40*a* is formed in a groove shape elongated in the front and rear direction of the belt-side housing 40. A belt-side outlet 40*b* (discharging part) which communicates an inside and an outside of the belt-side housing 40 is opened in a rear end bottom surface of the belt-side housing chamber 40*a* (see FIG. 5). The belt-side outlet 40*b* is formed to be able to discharge the toner conveyed by the belt-side screw 44 to the outside of the belt-side housing 40.

As shown in FIG. 5, both front and rear end parts of the rotation axis 44*a* fit to a pair of bearings 40*c* attached to both front and rear outer faces of the belt-side housing 40. As shown in FIGS. 5 and 6, flange parts 47*a* and bearing fitting parts 47*b* are formed at the both front and rear end parts of the rotation axis 44*a*, respectively. Incidentally, FIGS. 5 and 6 show only a rear side of the belt-side screw 44. The rear side of the rotation axis 44*a* will be focused upon and described below.

Each flange part 47*a* widens from the circumferential face of the rotation axis 44*a* to the outside in the radial direction. Each flange part 47*a* is formed in a disk shape having the same axial center as that of the rotation axis 44*a*. Each flange part 47*a* rotatably fits to each of opening parts 40*d* bored in both front and rear sidewalls of the belt-side housing 40.

As shown in FIG. 6, each bearing fitting part 47*b* is protruded rearward from a rear end face of each flange part 47*a*. Each bearing fitting part 47*b* is formed in a cuboid shape having the same axial center as that of the rotation axis 44*a* (flange parts 47*a*). Each bearing fitting part 47*b* is supported by each of the bearings 40*c* (see FIG. 5) fixed to an outside (rear side) of each opening part 40*d*.

Incidentally, the bias brush 41, the collection roller 42 and the belt-side screw 44 are connected to a cleaning motor 28*a* via the gear train (not shown) (FIG. 2). The cleaning motor 28*a* is electrically connected to the interface 13*d* (see FIG. 2), and is controlled to be driven by the CPU 13*a*.

As shown in FIGS. 5 and 6, the belt-side removing member 45 is attached to a rear end part (near the flange part 47*a*) of the rotation axis 44*a*. The belt-side removing member 45 is elongated from the rotation axis 44*a* to the outside in the radial direction. The belt-side removing member 45 is formed in a comb shape formed by continuously forming recesses and protrusions at a free end part of the belt-side removing member 45.

The belt-side removing member 45 includes an attachment cylinder part 45*a* and three comb parts 45*b*. The attachment cylinder part 45*a* and each comb part 45*b* are integrally formed by using a conductive material, such as conductive POM (polyacetal).

As shown in FIGS. 6 and 7, the attachment cylinder part 45*a* is formed in a nearly cylindrical shape, and a slit 48 is cut in a longitudinal direction. The inner diameter of the attachment cylinder part 45*a* is formed to be equal to or less than the outer diameter of the rotation axis 44*a*. The rotation axis 44*a* is fitted to the attachment cylinder part 45*a* formed by widening the slit 48 in a broken line arrow direction shown in FIG. 7. In this state, the inner circumferential face of the attachment cylinder part 45*a* is closely attached to the outer circumferential face of the rotation axis 44*a*.

The three comb parts 45*b* are arranged in parallel in the comb shape along an axial direction of the belt-side screw 44. More specifically, the three comb parts 45*b* are arranged in parallel along one rim part 48*a* of the slit 48. A gap G is formed between the neighboring comb parts 45*b* (see FIG. 6). The three comb parts 45*b* is formed respectively in a nearly rectangular flat shape, and is elongated from the rim part 48*a* to the outside in the radial direction. Each comb part 45*b* is elongated in a direction crossing to a tangent line L passing through the rim part 48*a* (see FIG. 7).

As shown in FIG. 7, a grip piece 45*c* which is in parallel to each comb part 45*b* is formed at the other rim part 48*b* of the slit 48. The grip piece 45*c* is formed over the longitudinal direction of the attachment cylinder part 45*a*. The grip piece 45*c* is formed to be sufficiently shorter than (equal to or less than half of) each comb part 45*b*.

As shown in FIG. 1, the four drum cleaning devices 34 the number of which corresponds to the number of the four photosensitive drums 30 provided in the apparatus main body 2 are provided. Incidentally, the four drum cleaning devices 34 employ the same configuration, and therefore one drum cleaning device 34 will be described below.

As shown in FIG. 8, the drum cleaning devices 34 includes a drum-side housing 50, a polishing roller 51, a restricting roller 52, a cleaning blade 53, a drum-side screw 54 and a drum-side removing member 55 (see FIG. 3).

The drum-side housing 50 is formed in a nearly box shape whose left face opposing to the photosensitive drums 30 is opened. The drum-side housing 50 houses the remaining toner removed from the surface of each photosensitive drum 30.

The polishing roller 51 is formed in a nearly cylindrical shape elongated in the front and rear direction. The polishing roller 51 is supported by the drum-side housing 50 rotatably around the axis. The polishing roller 51 is arranged to oppose to a right side of the photosensitive drums 30. The polishing roller 51 is exposed through an opening of the drum-side housing 50 to place an outer circumferential face of the polishing roller 51 in contact with each photosensitive drum 30. The polishing roller 51 rotates with (rotates in a trailing direction) each photosensitive drum 30.

The restricting roller 52 is formed in a nearly cylindrical shape elongated in the front and rear direction. The restricting roller 52 is supported by the drum-side housing 50 rotatably around the axis. The restricting roller 52 is arranged at a lower right side of the polishing roller 51. An outer circumferential face of the restricting roller 52 is in contact with an outer circumferential face of the polishing roller 51. The restricting roller 52 rotates with (rotates in the trailing direction) with the polishing roller 51.

The cleaning blade 53 is formed in a flat shape made of a synthetic resin, for instance. The cleaning blade 53 is fixed to a lower part of the drum-side housing 50, and has a distal end part exposed through the opening of the drum-side housing 50. The distal end part of the cleaning blade 53 is in contact in a counter direction of a rotation direction of the photosensitive drums 30.

The drum-side screw 54 is formed by fixing screw vanes 54*b* of spiral shapes to a circumferential face of a rotation axis 54*a* elongated in the front and rear direction and pivotally supported by the drum-side housing 50. The drum-side screw 54 is arranged below the polishing roller 51. The drum-side screw 54 is housed in a drum-side housing chamber 50*a* formed at a left bottom surface of the drum-side housing 50. As shown in FIG. 3, a drum-side outlet 50*b* (discharging part) which communicates an inside and an outside of the drum-side housing 50 is opened in a rear end bottom surface of the drum-side housing chamber 50*a*. The drum-side screw 54 rotates in accordance with the photosensitive drums 30. Incidentally, the drum-side screw 54 adopts substantially the same structure as that of the belt-side screw 44 of the belt-cleaning device 28 mentioned above, and therefore will not be described in detail.

The drum-side removing member 55 is attached to a rear end part of the rotation axis 54*a*. The drum-side removing member includes a cylinder part 55*a* and three comb parts 55*b*. Incidentally, the drum-side removing member 55 adopts substantially the same structure as that of the belt-side removing member 45 of the belt-cleaning device 28 as mentioned above, and therefore will not be described in detail.

Incidentally, the polishing roller 51, the restricting roller 52 and the drum-side screw 54 rotate in accordance with the photosensitive drums 30 and the like yet are not limited to this, and may be driven by the motor to rotate.

As shown in FIG. 9, the discharge conveying device 37 includes a conveying housing 60, a conveying screw 61 and a conveying removing member 62.

The conveying housing 60 includes a housing main body 60*a*, a belt-side inlet pipe 60*b*, four drum-side inlet pipes 60*c* and a conveying outlet 60*d*.

The housing main body 60*a* is formed in a nearly cuboid shape which is long in the left and right direction. The belt-side inlet pipe 60*b* and each drum-side inlet pipe 60*c* are vertically provided on an upper face of the housing main body 60*a*. The belt-side inlet pipe 60*b* communicates the belt-side outlet 40*b* of the belt cleaning device 28 and an inside of the housing main body 60*a*. Each drum-side inlet pipe 60*c* communicates the drum-side outlet 50*b* of the drum cleaning device 34 and the inside of the housing main body 60*a*. The conveying outlet 60*d* is opened in a rear end bottom surface of the housing main body 60*a*. The conveying outlet 60*d* is connected with the toner collection container 63 which collects the remaining toner removed by each of the cleaning devices 28 and 34.

The conveying screw 61 is formed by fixing screw vanes 61*b* of spiral shapes to a circumferential face of a rotation axis 61*a* elongated in the left and right direction and pivotally supported by the housing main body 60*a*. The conveying screw 61 is connected to the cleaning motor 28*a* (or the drum motor 30*a*) via the gear train (not shown). Incidentally, the conveying screw 61 adopts substantially the same structure as that of the belt-side screw 44 of the belt cleaning device 28 mentioned above, and therefore will not be described in detail.

The conveying removing member 62 is attached to a right end part of the rotation axis 61*a*. The conveying removing member includes a cylinder part 62*a* and three comb parts 62*b*. Incidentally, the conveying removing member 62 adopts substantially the same structure as that of the belt-side removing member 45 of the belt-cleaning device 28 as mentioned above, and therefore will not be described in detail.

Incidentally, each of the belt-side screw 44, the drum-side screw 54 and the conveying screw 61 are electrically connected to the bias power supply 46 (see FIG. 2). The bias power supply 46 is controlled by the control device 13 to apply the bias of the polarity opposite to the charging polarity of the remaining toner to the screws 44, 54 and 61 and the removing members 45, 55 and 62.

Next, a function (remaining toner removal processing) of the cleaning structure 5 will be described. Incidentally, it is assumed in the following description that remaining toner adhered to the surface of the intermediate transfer belt 27 is mainly charged positively. The bias power supply 46 is controlled by the control device 13 to apply a bias of a negative polarity to the bias brush 41 and each of the screws 44, 54 and 61 (each of the removing members 45, 55 and 62).

At first, a function of the belt cleaning device 28 will be described. When image formation processing is executed, the cleaning motor 28*a* is controlled by the control device 13 to rotate the bias brush 41, the collection roller 42 and the belt-side screw 44.

The bias brush 41 relatively slides on the surface of the orbiting intermediate transfer belt 27 (see FIG. 4). The remaining toner adhered to the surface of the intermediate transfer belt 27 is adsorbed to the bias brush 41 by an electrostatic adsorption force. Consequently, it is possible to remove the remaining toner from the surface of the intermediate transfer belt 27.

The collection roller 42 receives the remaining toner moved to the bias brush 41. The collection blade 43 scrapes the remaining toner moved to the collection roller 42. The remaining toner removed from the collection roller 42 is housed in the belt-side housing 40 (belt-side housing chamber 40*a*). The belt-side screw 44 conveys the remaining toner in the belt-side housing chamber 40*a*, to the belt-side outlet 40*b* (see an arrow in FIG. 3). The remaining toner is injected in the housing main body 60*a* from the belt-side outlet 40*b* through the belt-side inlet pipe 60*b* (see an arrow in FIG. 9).

Next, a function of the drum cleaning device 34 will be described. When the image formation processing is executed, the drum motor 30*a* is controlled by the control device 13 to rotate the photosensitive drums 30 (see FIG. 8). The polishing roller 51, the restricting roller 52 and the drum-side screw 54 rotate in accordance with the photosensitive drum 30.

The polishing roller 51 relatively slides on the surface of each photosensitive drum 30 after a toner image is transferred to the sheet S. The restricting roller 52 rotates in the trailing direction with respect to the polishing roller 51, and makes the thickness of a remaining toner layer adhered to the polishing roller 51 even. The polishing roller 51 around which the remaining toner layer has been formed polishes the surface of each photosensitive drum 30. The cleaning blade 53 scrapes the remaining toner adhered to the surface of each photosensitive drum 30. Consequently, it is possible to remove the remaining toner and nitrogen oxide from the surface of each photosensitive drum 30.

The remaining toner removed from each photosensitive drum 30 is housed in the drum-side housing 50. The drum-side screw 54 conveys the remaining toner in the drum-side housing 50, to each drum-side outlet 50*b* (see the arrow in FIG. 3). The remaining toner is injected in the housing main body 60*a* from each drum-side outlet 50*b* through the drum-side inlet pipe 60*c* (see an arrow in FIG. 9).

Next, a function of the discharge conveying device 37 will be described. When the image formation processing is executed, the conveying screw 61 is driven by the cleaning motor 28*a* to rotate. The conveying screw 61 conveys the remaining toner injected in the housing main body 60*a* through the belt-side inlet pipe 60*b* and the drum-side inlet pipe 60*c*, to the conveying outlet 60*d* (see the arrow in FIG. 9). The remaining toner is discharged (collected) by the toner collection container 63 through the conveying outlet 60*d* (see FIG. 9).

In this regard, when the color printer 1 is left in high-temperature environment, the remaining toner is likely to adhere to each of the screws 44, 54 and 61, and is likely to remain at each of the outlets 40*b*, 50*b* and 60*d*. Hence, the cleaning structure 5 according to the first embodiment includes each of the removing members 45, 52 and 62 which prevents the remaining toner from remaining at each of the outlets 40*b*, 50*b* and 60*d*. Each of the removing members 45, 55 and 62 rotates with each of the screws 44, 54 and 61 to remove the remaining toner remaining at each of the outlets 40*b*, 50*b* and 60*d*. Incidentally, the functions and the effects of the belt cleaning device 28, the drum cleaning device 34 and the discharge conveying device 37 are substantially the same, and therefore the function and the effect of the belt cleaning device 28 will be focused upon and described below.

As shown in FIG. 5, the belt-side removing member 45 of the belt cleaning device 28 is fitted to the rotation axis 44*a*, and therefore rotates with the belt-side screw 44. The distal end part of each comb part 45*b* of the belt-side removing member 45 scrapes the remaining toner remaining at the belt-side outlet 40*b*. The scraped remaining toner drops from the belt-side outlet 40*b* to the belt-side inlet pipe 60*b*. Consequently, it is possible to prevent the remaining toner from remaining at the belt-side outlet 40*b*.

Further, the belt-side removing member 45 is formed in a comb shape, and therefore the scraped remaining toner are discharged to an outside of the belt-side housing 40 from the discharging part through the gap G between the combs (the neighboring comb parts 45G. That is, the belt-side removing member 45 does not rotate holding the remaining toner. Thus, by forming the belt-side removing member 45 in the comb shape, it is possible to prevent the remaining toner from adhering to the belt-side removing member 45.

Further, according to the belt cleaning device 28 according to the first embodiment, a potential opposite to the charging polarity of the remaining toner is applied from the bias power supply 46 to the belt-side screw 44 and the belt-side removing member 45. Then, the remaining toner hardly adheres electrically to the belt-side screw 44 and the belt-side removing member 45. Consequently, it is possible to appropriately prevent the remaining toner from adhering to the belt-side removing member 45 and the like. Incidentally, the drum cleaning device 34 (drum-side removing member 55) and the discharge conveying device 37 (conveying removing member 62) can also provide substantially the same function and effect as those of the belt cleaning device 28 (belt-side removing member 45).

Incidentally, the above-mentioned belt-side removing member 45 is made of a conductive synthetic resin in the above-mentioned belt cleaning device 28 yet the present disclosure is not limited to this. According to a modified example of the first embodiment, the belt-side removing member 45 may be formed by a metal plate. The belt-side removing member 45 is formed by, for instance, bending or punching a plate made of stainless steel. Incidentally, surface roughness (surface property) of the belt-side removing member 45 is preferably 0.4 μm or less in terms of an arithmetic average roughness (Ra).

Thus, by forming the belt-side removing member 45 by the metal plate having the smooth surface property, it is possible to effectively prevent the remaining toner from adhering to the belt-side removing member 45. Incidentally, similar to the belt-side removing member 45, the drum-side removing member 55 of the drum cleaning device 34 and the conveying removing member 62 of the discharge conveying device 37 may be formed by metal plates.

Figure 10:
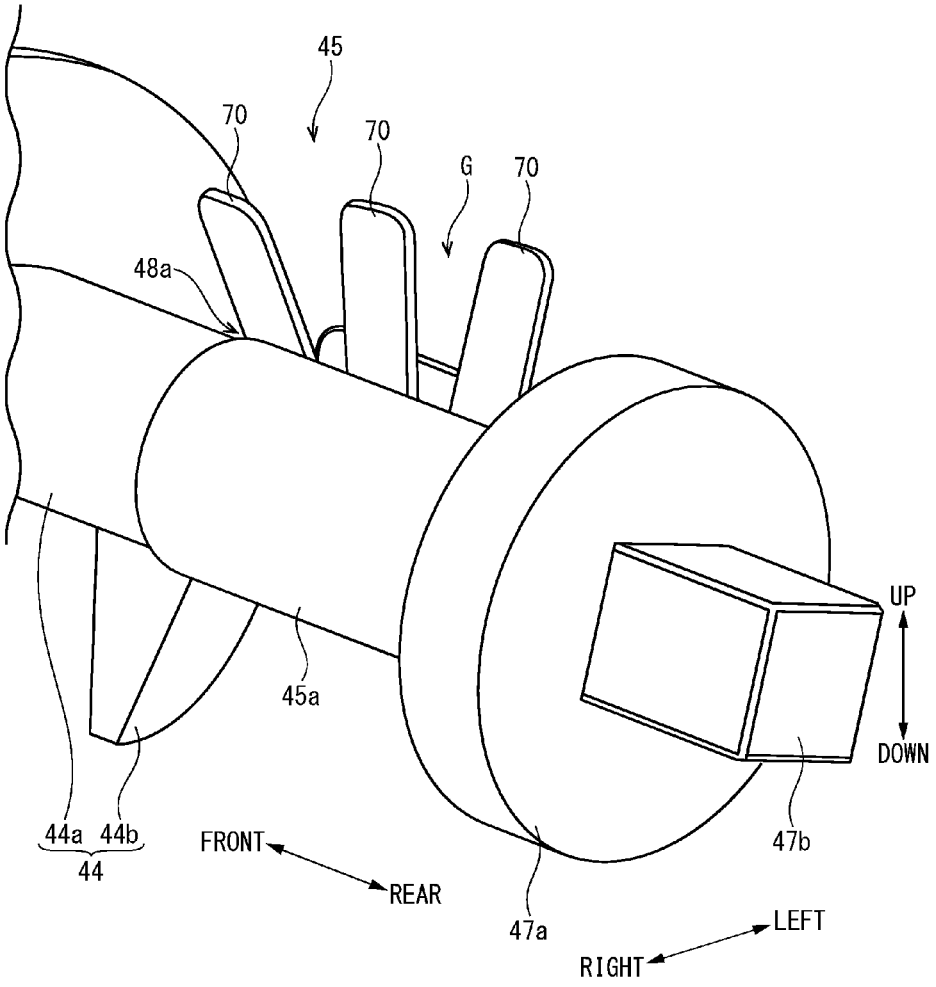
FIG. 10 is a perspective view showing a belt-side removing member of the belt cleaning device according to the second embodiment of the present disclosure.

Next, with reference to FIG. 10, a belt cleaning device 28 according to a second embodiment, will be described. FIG. 10 is a perspective view showing a belt-side removing member 45. Incidentally, the same components as those of the belt cleaning device 28 according to the first embodiment will be assigned the same reference numerals and will not be described below.

In the first embodiment, the three comb parts 45*b* are aligned in a row and extend in the same direction. However, in the second embodiment, as shown in FIG. 10, free end parts of three comb parts 70 are provided by shifting positions of the free end parts in the rotation direction of the belt-side screw 44. That is, the three comb parts 70 are arranged in parallel at the rim part 48*a* at different angles. In other words, the three comb parts 70 respectively extend in different directions.

According to this configuration, the gap G between the neighboring comb parts 70 widens in the axial direction and the rotation direction, so that a remaining toner can smoothly pass through the gap G. Consequently, it is possible to effectively prevent the remaining toner from remaining at the belt-side outlet 40*b*.

Figure 11:
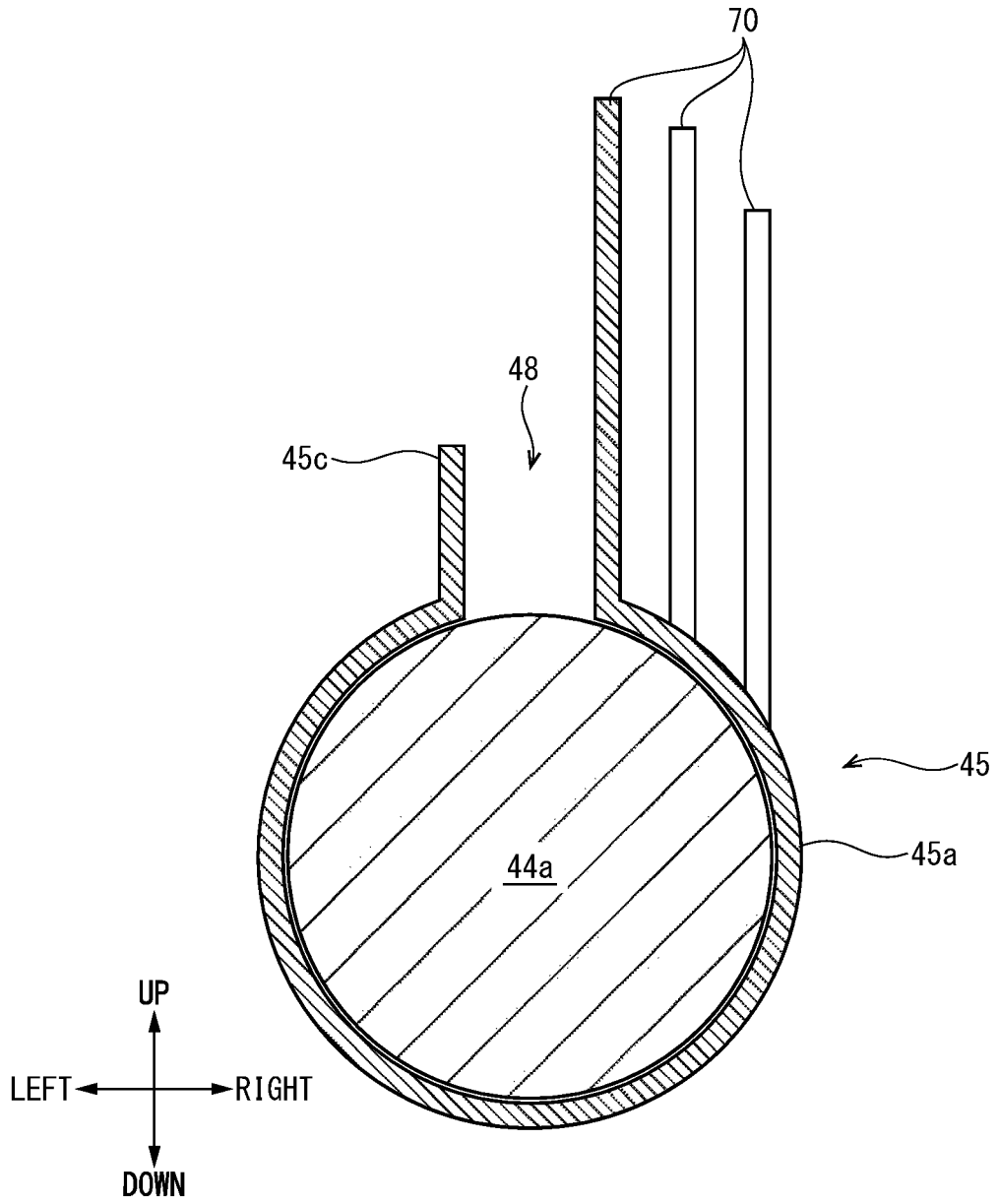
FIG. 11 is a sectional view schematically showing a belt-side removing member of a belt cleaning device according to a modified example of the second embodiment of the present disclosure.
Figure 12:
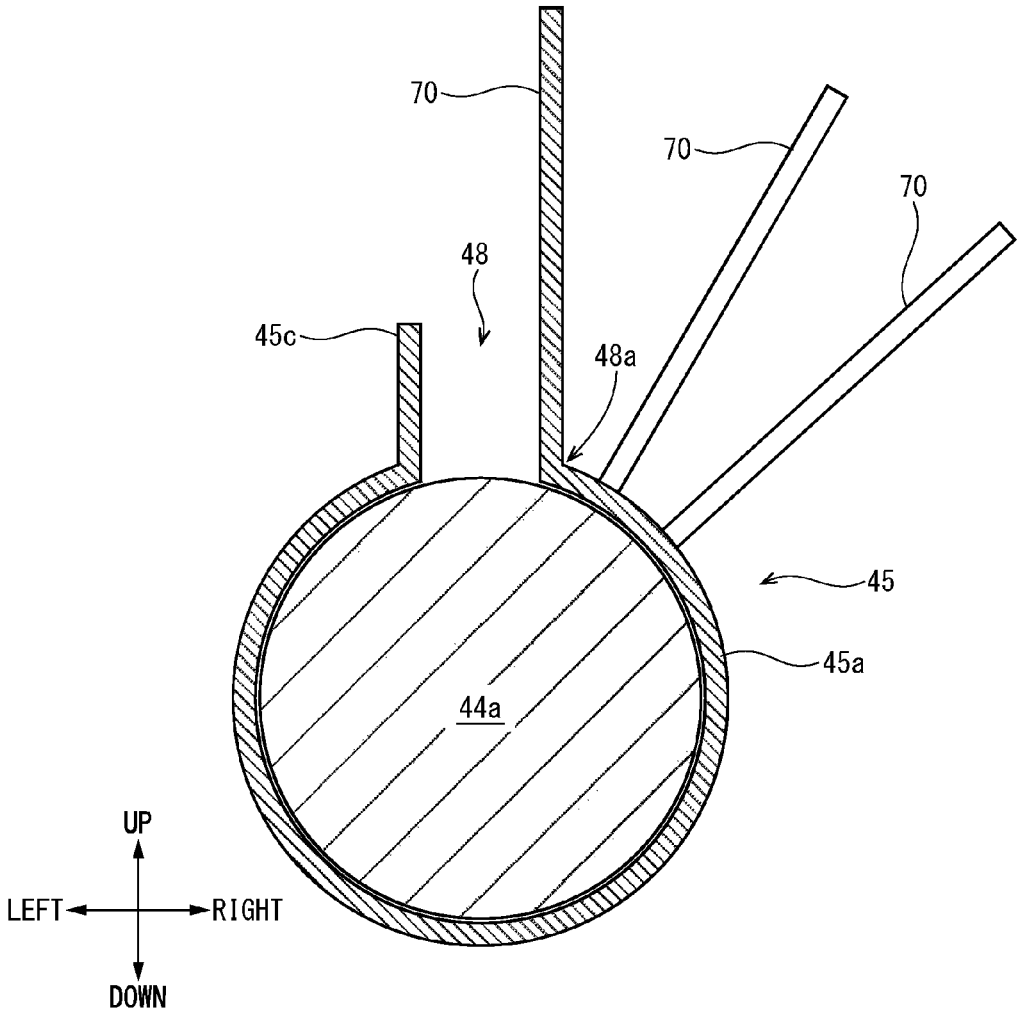
FIG. 12 is a sectional view schematically showing a belt-side removing member of a belt cleaning device according to another modified example of the second embodiment of the present disclosure.

Incidentally, the three comb parts 70 are arranged in parallel at the rim part 48*a*. However, the present disclosure is not limited to this. As shown in FIG. 11, for instance, the three comb parts 70 may be vertically provided respectively in parallel at positions shifted in the rotation direction of the attachment cylinder part 45*a*. Additionally, as shown in FIG. 12, for instance, the three comb parts 70 may be vertically provided at positions shifted in the rotation direction of the attachment cylinder part 45*a* and at different angles. Incidentally, the drum cleaning device 34 and the discharge conveying device 37 can also provide substantially the same function and effect as those of the belt cleaning device 28.

Incidentally, the belt-side removing member 45 of the belt cleaning device 28 according to the first (including the modified example, which applies likewise below) and second embodiments include the three comb parts 45*b* (70). However, the present disclosure is not limited to this. The two or more comb parts 45*b* (70) may be formed. Incidentally, the same applies to the comb parts 55*b* of the drum cleaning device 34 and the comb parts 62*b* of the discharge conveying device 37, too.

Figure 13:
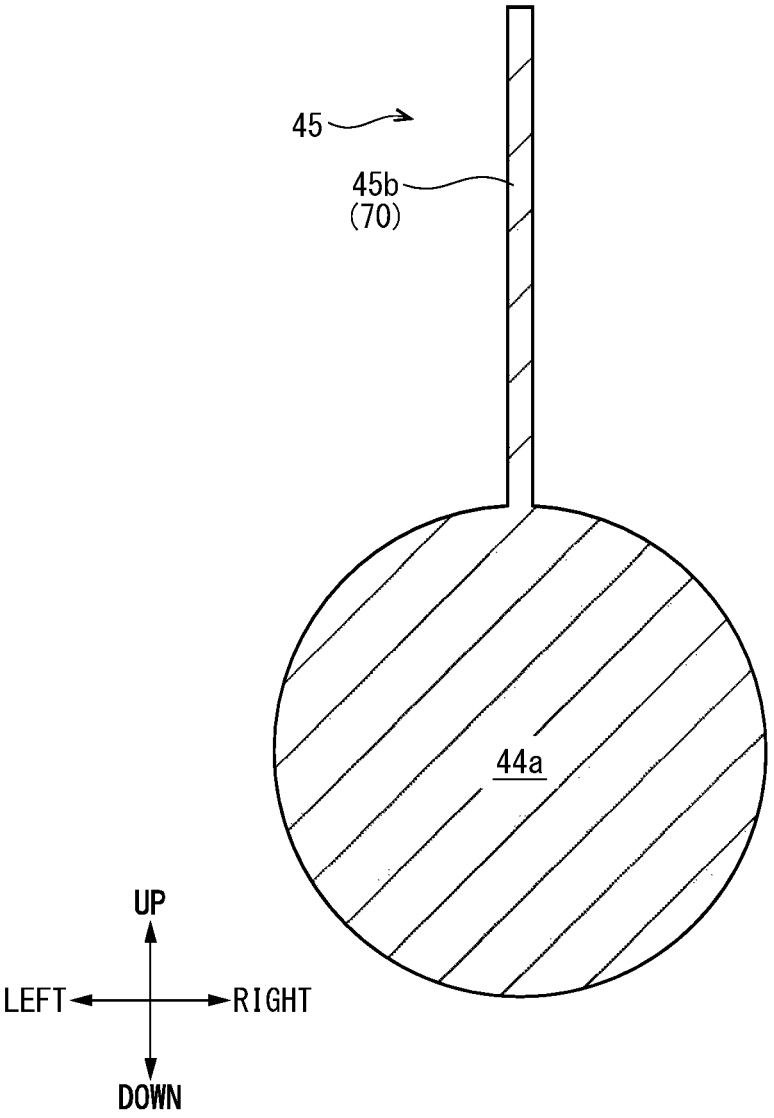
FIG. 13 is a sectional view schematically showing a belt-side removing member of a belt cleaning device according to modified examples of the first and second embodiments of the present disclosure.

Incidentally, the belt-side removing member 45 of the belt cleaning device 28 according to the first and second embodiments are attachably and detachably attached to the rotation axis 44*a*. However, the present disclosure is not limited to this. As shown in FIG. 13, for instance, the attachment cylinder part 55*a* may be omitted, and each comb part 45*b* (70) may be vertically provided directly on the surface of the rotation axis 44*a*. That is, the belt-side removing member 45 may be integrally formed with the rotation axis 44*a*. Incidentally, the same applies to the drum-side removing member 55 (comb parts 55*b*) of the drum cleaning device 34 and the conveying removing member 62 (comb parts 62*b*) of the discharge conveying device 37, too.

Still further, the case in which the present disclosure is applied to the color printer 1 as one example has been described in the present embodiment, the present disclosure is not limited to such case, and the present disclosure is applicable also to a monochrome printer, a copying machine, a facsimile, a multi-function printer or the like.

While the preferable embodiment and its modified example of the toner conveying device and the image forming apparatus or the like of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A toner conveying device comprising:

a housing configured to house toner;

a screw formed by fixing a vane of a spiral shape to a circumferential face of a rotation axis rotatably supported in the housing;

a discharging part formed to be able to discharge the toner conveyed by the screw, to an outside of the housing; and a removing member elongated from the rotation axis to an outside in a radial direction and configured to rotate with the screw and remove the toner remaining at the discharging part, wherein the removing member includes:

an attachment cylinder part around which a slit is cut along the rotation axis, and which is formed in a cylindrical shape to which the rotation axis fits;

a plurality of comb parts arranged in parallel along a first rim part of the slit and elongated from the first rim part to the outside in the radial direction; and a grip piece formed along a second rim part of the slit and elongated from the second rim part to the outside in the radial direction, the grip piece is formed to be shorter than the comb parts.

2. The toner conveying device according to claim 1, wherein the comb parts extend in a direction crossing to a tangent line passing the first rim part.

3. A toner conveying device comprising:

a housing configured to house toner;

a screw formed by fixing a vane of a spiral shape to a circumferential face of a rotation axis rotatably supported in the housing;

a discharging part formed to be able to discharge the toner conveyed by the screw, to an outside of the housing; and a removing member elongated from the rotation axis to an outside in a radial direction and configured to rotate with the screw and remove the toner remaining at the discharging part, wherein the removing member includes:

an attachment cylinder part around which a slit is cut along the rotation axis, and which is formed in a cylindrical shape to which the rotation axis is fitted; and a plurality of comb parts arranged in parallel along an axial direction of the screw, and free end parts of the plurality of comb parts are provided by shifting positions of the free end parts in a rotation direction of the screw, and the plurality of comb parts are arranged in parallel along a first rim part of the slit at different angles and are elongated from the first rim part to the outside in the radial direction.

4. A toner conveying device comprising:

a housing configured to house toner;

a screw formed by fixing a vane of a spiral shape to a circumferential face of a rotation axis rotatably supported in the housing;

a discharging part formed to be able to discharge the toner conveyed by the screw, to an outside of the housing; and a removing member elongated from the rotation axis to an outside in a radial direction and configured to rotate with the screw and remove the toner remaining at the discharging part, wherein the removing member includes;

an attachment cylinder part around which a slit is cut along the rotation axis, and which is formed in a cylindrical shape to which the rotation axis is fitted; and a plurality of comb parts arranged in parallel along an axial direction of the screw, and free end parts of the plurality of comb parts are provided by shifting positions of the free end parts in a rotation direction of the screw, and the plurality of comb parts are vertically provided in parallel at positions shifted in a rotation direction of the attachment cylinder part.

5. The toner conveying device according to claim 1, wherein the removing member is integrally formed with the rotation axis.

6. The toner conveying device according to claim 1, further comprising a bias power supply electrically connected to the screw, wherein the screw and the removing member are respectively made of a conductive material, and the bias power supply applies a bias of a polarity opposite to a charging polarity of the toner, to the conveying screw and the removing member.

7. The toner conveying device according to claim 1, wherein the removing member is formed by a metal plate.

8. An image forming apparatus including the toner conveying device according to claim 1, comprising an image carrier configured to carry a toner image; wherein the toner conveying device removes toner remaining on a surface of the image carrier.

9. The image forming apparatus according to claim 8, further comprising a toner collection container configured to collect the toner removed by the toner conveying device, wherein a plurality of the image carriers are provided in an apparatus main body, and a plurality of the toner conveying devices a number of which corresponds to a number of the image carriers are provided.

10. An image forming apparatus including the toner conveying device according to claim 3, comprising an image carrier configured to carry a toner image; wherein the toner conveying device removes toner remaining on a surface of the image carrier.

11. The image forming apparatus according to claim 10, further comprising a toner collection container configured to collect the toner removed by the toner conveying device, wherein a plurality of the image carriers are provided in an apparatus main body, and a plurality of the toner conveying devices a number of which corresponds to a number of the image carriers are provided.

12. An image forming apparatus including the toner conveying device according to claim 4, comprising an image carrier configured to carry a toner image; wherein the toner conveying device removes toner remaining on a surface of the image carrier.

13. The image forming apparatus according to claim 12, further comprising a toner collection container configured to collect the toner removed by the toner conveying device, wherein a plurality of the image carriers are provided in an apparatus main body, and a plurality of the toner conveying devices a number of which corresponds to a number of the image carriers are provided.

* * * * *